US008075395B2

(12) United States Patent
Sylla

(10) Patent No.: US 8,075,395 B2
(45) Date of Patent: Dec. 13, 2011

(54) WAGERING GAME MACHINE HAVING IMAGE COPIED FILE SYSTEM

(75) Inventor: Craig J. Sylla, Round Lake, IL (US)

(73) Assignee: WMS Gaming Inc., Waukegan, IL (US)

( * ) Notice: Subject to any disclaimer, the term of this patent is extended or adjusted under 35 U.S.C. 154(b) by 682 days.

(21) Appl. No.: 12/158,014

(22) PCT Filed: Dec. 8, 2006

(86) PCT No.: PCT/US2006/047160

§ 371 (c)(1),
(2), (4) Date: Jun. 18, 2008

(87) PCT Pub. No.: WO2007/078654

PCT Pub. Date: Jul. 12, 2007

(65) Prior Publication Data

US 2008/0300038 A1 Dec. 4, 2008

Related U.S. Application Data

(60) Provisional application No. 60/743,056, filed on Dec. 20, 2005.

(51) Int. Cl.
*A63F 9/24* (2006.01)

(52) U.S. Cl. ..... 463/29

(58) Field of Classification Search ..... 463/25, 463/29

See application file for complete search history.

(56) References Cited

U.S. PATENT DOCUMENTS

2002/0188940 A1* 12/2002 Breckner et al. ..... 717/175
2003/0203756 A1* 10/2003 Jackson ..... 463/42

OTHER PUBLICATIONS

"International Search Report for Application No. PCT/US2006/47160, date mailed Nov. 21, 2007", 4 pgs.
"Written Opinion of the International Searching Authority for Application No. PCT/US2006/47160, date mailed Nov. 21, 2007", 6 pgs.
"Application Serial No. PCT/US2006/047160, International Preliminary Examination Report mailed Mar. 23, 2009", 9 pgs.

* cited by examiner

*Primary Examiner* — Omkar Deodhar
(74) *Attorney, Agent, or Firm* — Schwegman, Lundberg & Woessner, P.A.

(57) ABSTRACT

Systems and methods provide a mechanism for a wagering game machine to access game components on an image file system contained in a disk image file that resides on a second file system. The gaming components may include banner content, advertising content, denomination data, pay table, language data, video content, audio content, episodic game data, wagering game software, operating system software, device driver software and device firmware.

20 Claims, 6 Drawing Sheets

WAGERING GAME MACHINE HAVING IMAGE COPIED FILE SYSTEM

RELATED APPLICATIONS

This patent application is a U.S. National Stage Filing under 35 U.S.C. 371 from International Patent Application Serial No. PCT/US2006/047160, filed Dec. 8, 2006, and published on Jul. 12, 2007 as WO 2007/078654 A2 and republished as WO 2007/078654 A3, which claims the benefit of priority of U.S. Provisional Patent Application Ser. No. 60/743,056 filed on Dec. 20, 2005 and entitled "WAGERING GAME MACHINE HAVING A FILE SYSTEM ON A STORAGE MEDIA IMAGE COPIED TO A PERSISTENT MEMORY", the contents of which are incorporated herein by reference in their entirety.

FIELD

The embodiments relate generally to wagering game machine file systems and more particularly to using a file system within a storage media image copied from one storage device to a wagering game machine storage device.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright© 2005, WMS Gaming Inc.

BACKGROUND

Wagering game machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and improved gaming enhancements that will attract frequent play through enhanced entertainment value to the player.

Current techniques for initially loading, modifying or replacing game software in wagering game machines are generally inconvenient, time-consuming, and expensive. In one technique, the entire wagering game machine is disconnected from the central server and replaced with a new machine. This involves the shipment of machines to and from a gaming establishment and requires the services of an appreciable number of skilled and semi-skilled service personnel. The service personnel must identify the machines to be replaced, locate the machines on the gaming establishment floor, and then replace the existing machines with the new machines. In another technique, the media containing the software is replaced with new media containing the new software. Again, the service personnel must identify the machines to receive the new software media, locate the machines on the gaming establishment floor, and then replace the (existing media with the new media. In this case, media may be a hard disk, flash, various non-volatile media such as EEPROM, EPROM, etc.

The complexity of the problem and the number of potential configurations increases rapidly with the number of wagering game machines that are maintained by a gaming establishment. Loading software onto wagering game machines thus typically requires significant personnel and hardware resources.

SUMMARY

Systems and methods provide gaming content through a file system contained within a physical image copied from a storage device to a storage device on a wagering game machine.

A further aspect of the systems and methods includes authenticating the gaming related content on the image file system. The authentication may be performed prior to loading the content on the wagering game machine or it may be performed after loading the files in the memory but prior to using the files.

The disclosure describes systems, methods, and computer-readable media of varying scope. In addition to the aspects and advantages described in this summary, further aspects of the inventive subject matter will become apparent by reference to the drawings and by reading the detailed description that follows.

DETAILED DESCRIPTION

Figure 1:
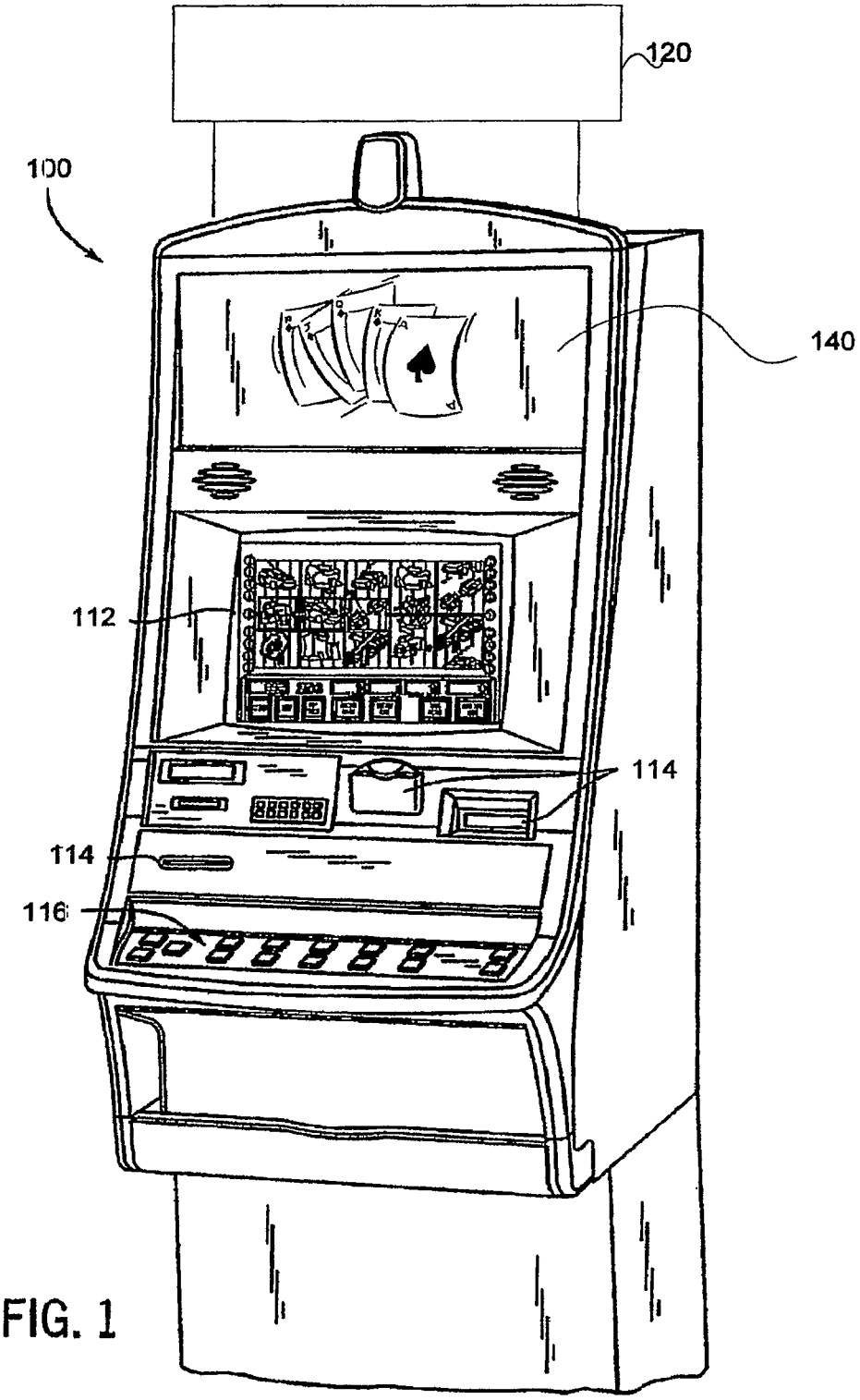
FIG. 1 is a perspective view of a wagering game machine according to an example embodiment.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the inventive subject matter, and it is to be understood that other embodiments may be utilized end that logical, mechanical, electrical and other changes may be made without departing from the scope of the inventive subject matter.

Some portions of the detailed descriptions which follow are presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities. Unless specifically stated otherwise as apparent from the following discussions, terms such as "processing" or "computing" or "calculating" or "determining" or "displaying" or the like, refer to the action and processes of a computer system, or similar computing device, that manipulates and transforms data represented as physical (e.g., electronic) quantities within the computer system's registers and memories into other data similarly represented as physical quantities within the computer system memories or registers or other such information storage, transmission or display devices.

In the Figures, the same reference number is used throughout to refer to an identical component that appears in multiple Figures. Signals and connections may be referred to by the same reference number or label, and the actual meaning will be clear from its use in the context of the description.

The description of the various embodiments is to be construed as exemplary only and does not describe every possible instance of the inventive subject matter. Numerous alternatives could be implemented, using combinations of current or future technologies, which would still fall within the scope of the claims. The following detailed description is, therefore, not to be taken in a limiting sense, and the scope of the inventive subject matter is defined only by the appended claims.

FIG. 1 illustrates an example wagering game machine 100 in which may be included various embodiments of the invention. In some embodiments, wagering game machine 100 is operable to conduct a wagering game. These wagering games may include reel based wagering games such as mechanical or video slots, card based games such as video poker, or other types of wagering games such as video keno, video bingo or a video dice game. If based in video, the wagering game machine 100 includes a video display 112 such as a cathode ray tube (CRT), liquid crystal display (LCD), plasma, or other type of video display known in the art. In the illustrated embodiment, the wagering game machine 100 is an "upright" version in which the display 112 is oriented vertically relative to a player. Alternatively, the wagering game machine may be a "slant-top" version in which the display 112 is slanted at about a thirty-degree angle toward the player. Further, the wagering game machine may be a "bar-top" version in which the display is mounted horizontally in a bar top or table top. Still further, the wagering game machine may be housed in a wall mounted or other vertically mounted cabinet. In yet further embodiments, the wagering game machine may be housed in a portable or handheld device. In such devices, the user interface elements (buttons, screen etc.) may be scaled down or eliminated in order to fit the elements into an appropriate housing for a handheld or portable wagering game machine.

The wagering game machine 100 may include a plurality of possible credit receiving mechanisms 114 for receiving credits to be used for placing wagers in the game. The credit receiving mechanisms 114 may, for example, include a coin acceptor, a bill acceptor, a ticket reader, and a card reader. The bill acceptor and the ticket reader may be combined into a single unit. The card reader may, for example, accept magnetic cards and smart (chip) cards coded with money or designating an account containing money.

In some embodiments, the wagering game machine 100 includes a user interface comprising a plurality of push-buttons 116, and other possible devices. The plurality of push-buttons 116 may, for example, include one or more "bet" buttons for wagering, a "play" button for commencing play, a "collect" button for cashing out, a help" button for viewing a help screen, a "pay table" button for viewing the pay table(s), and a "call attendant" button for calling an attendant. Additional game specific buttons may be provided to facilitate play of the specific game executed on the machine. A touch screen overlaying video display 112 may define touch keys for implementing many of the same functions as the push-buttons. Additionally, in the case of video poker, the touch screen may implement a card identification function to indicate which cards a player desires to keep for the next round. Other possible user interface devices include a keyboard and a pointing device such as a mouse or trackball.

In some embodiments, wagering game machine 100 includes a top box 140. Top box 140 may contain a video display, a mechanical display, or a diorama display that supplements display 112. For example, the display in top box 140 may be a wheel such as a rotating wheel, mechanical dice, a board for a board game, or other such display.

A processor controls operation of the wagering game machine 100. In response to receiving a wager and a command to initiate play, the processor randomly selects a game outcome from a plurality of possible outcomes and causes the display 112 to depict indicia representative of the selected game outcome. In the case of slots for example mechanical or simulated slot reels are rotated and stopped to place symbols on the reels in visual association with one or more pay lines. If the selected outcome is one of the winning outcomes defined by a pay table, the CPU awards the player with a number of credits associated with the winning outcome.

In some embodiments, wagering game machine 100 may include signage 120. Signage 120 may be a display device capable of displaying advertising, gaming information (e.g. type of game, denomination of game etc.) or other information to a player or potential player.

Figure 2:
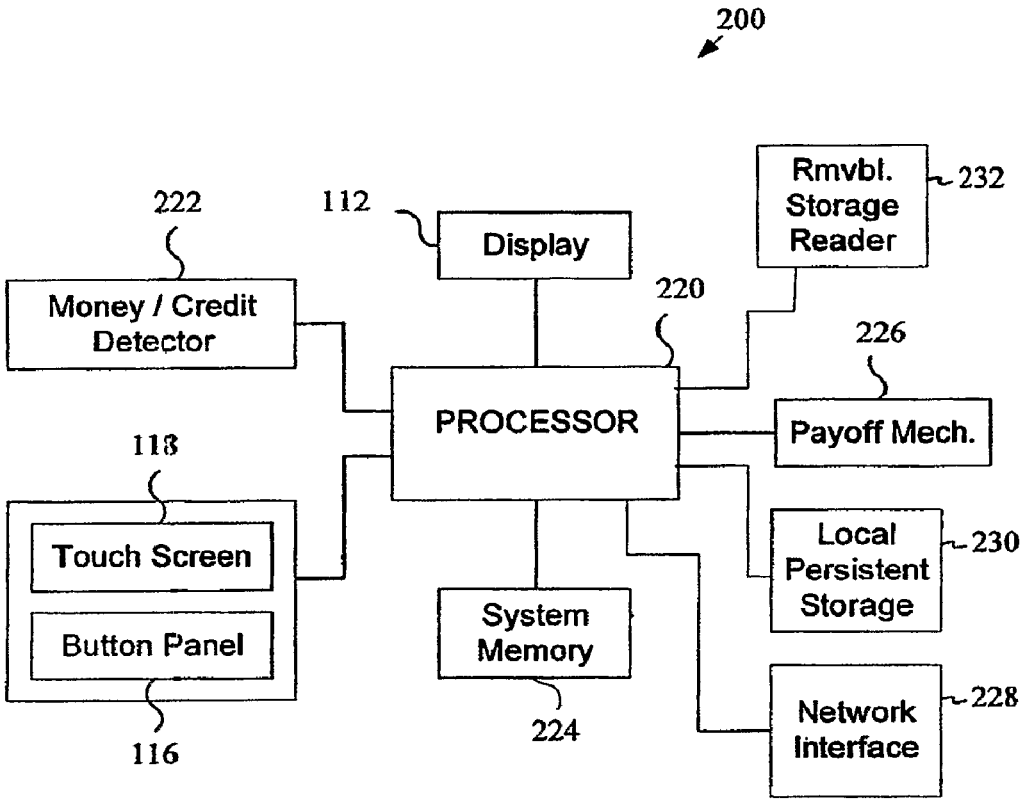
FIG. 2 is a block diagram of processing components of a wagering game machine according to an example embodiment.

FIG. 2 is a block diagram of a control system 200 suitable for operating the wagering game machine 100. Money/credit detector 222 signals a processor 220 when a player has inserted money, tickets, tokens, cards or other mechanism for obtaining credits for plays on the wagering game machine through credit mechanisms 114. Using a button panel 116 and/or a touch screen 218, the player may select any variables associated with the wagering game and place his/her wager to purchase a play of the game. In a play of the game, the processor 220 generates at least one random event using a random number generator (RNG) and provides an award to the player for a winning outcome of the random event. Alternatively, the random event may be generated by a remote computer using an RNG or pooling schema and then transmitted to the wagering game machine. The processor 220 operates the display 112 to represent the random event(s) and outcome(s) in a visual form that can be understood by the player. In addition to the processor 220, the control system may include one or more additional slave control units for operating the display 112 and any secondary displays.

System memory 224 stores control software, operational instructions and data associated with the wagering game machine. In some embodiments, the system memory 224 comprises a separate read-only memory (ROM) and battery-backed random-access memory (RAM). However, it will be appreciated that the system memory 224 may be implemented on any of several alternative types of memory structures or may be implemented on a single memory structure. For example, memory 224 may comprise multiple banks of volatile or non-volatile memory, including RAM, compact flash, hard drives, CD-ROM drives, DVD-ROM drives and combinations thereof.

A payoff mechanism 226 is operable in response to instructions from the processor 220 to award a payoff to the player. The payoff may, for example, be in the form of a number of credits. The number of credits is determined by one or more math tables stored in the system memory 224. As noted above with respect to FIG. 1, the payoff mechanism may be a coin hopper, a ticket printer, a magnetic card writer, or a database update mechanism that updates a database maintaining account information.

Network interface 228 operates to communicably couple system 200 in wagering game machine 100 to a network. The network may be any type of wired or wireless network and the network interface 228 may vary based on the type of network. In some embodiments, the network comprises a gaming establishment network such as a LAN (local area network). In alternative embodiments, the network may be an intranet linking multiple networks, for example, the networks of a gaming enterprise that operates multiple gaming establishments. In further alternative embodiments, the network may comprise the Internet.

Local persistent storage 230 comprises a storage unit that maintains information regardless of whether system 200 has been powered off or rebooted. Examples of such storage units include hard drives, flash memories, compact flash memories and other such storage devices.

Removable storage reader 232 comprises a device that reads removable storage media such as floppy disks, CDs (Compact Discs), DVDs (Digital Versatile Disc), removable flash memories and other removable storage.

In some embodiments, a removable media such as a CD or DVD may be inserted into removable storage reader 232. An image of the CD or DVD may then be copied onto the local persistent storage 230 and the CD or DVD may be removed. The image copied onto persistent storage comprises a copy of all of the data on the CD, DVD or other removable storage, and contains the complete contents and structure of the source data storage device. This may include file system data, volume data, and/or security related data. Further details on the operation of system 200 are provided below with reference to FIGS. 3-5.

Figure 3:
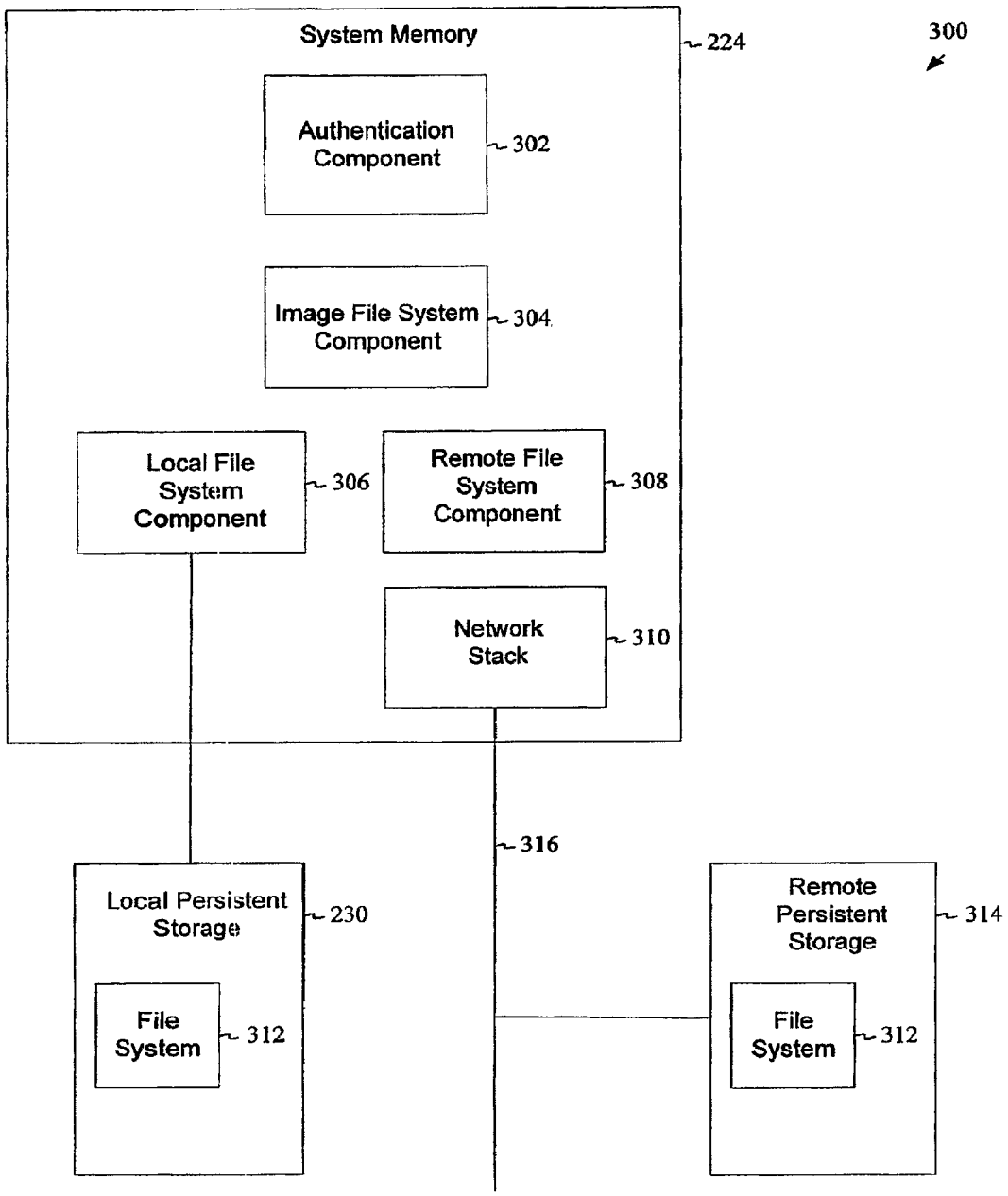
FIG. 3 is a block diagram of software components of a wagering game machine according to an example embodiment.

FIG. 3 is a block diagram of software components 300 of a wagering game machine according to an example embodiment. In some embodiments, software components 300 operate from system memory 224 and include an authentication component 302, an image file system component 304 and a local file system component 306.

Local file system component 306 manages a file system 312 stored on local persistent storage 228. A file system 312 provides a mechanism for storing and organizing computer files and the data they contain to make it easy to find and access the files. A file system typically comprises files stored in directories. The directories provide a mechanism to organize files. Directories may be organized in a tree structured hierarchy, with directories potentially containing both files and other directories. A file may be accessed by specifying its pathname, which comprises the names of a directory or directories that navigate through the file system hierarchy to the desired file, and the name of the desired file. A pathname may be anchored to a topmost level root directory, or it may be relative to a directory. Various file systems are available for various operating systems. For example, Linux systems may support Ext (Extended file system), Ext2, Ext3 file systems. Microsoft Windows based operating systems may support FAT (File Allocation Table) and NTFS (New Technology File System). Unix based operating systems may support UFS (Unix File System) and FFS (Fast File System). Other file systems exist and are within the scope of the description provided herein.

In some embodiments, system 200 may be communicably coupled to a remote persistent storage 314 through a network 316. Network 316 may be a wired network, a wireless network, or a combination of the two. Additionally, network 316 may be a local area network (LAN), a wide area network (WAN), corporate network or intranet, or the Internet.

Remote persistent storage 314 may reside on a file server, a storage area network (SAN) or other network attached storage (NAS) mechanism. In these embodiments, a remote file system component 308 manages requests for file data on remote persistent storage 314. Remote file system 310 typically communicates through a network stack 310. In some embodiments, network stack 310 may be a TCP/IP network stack. Remote file system component may implement any of a variety of remote file access protocols, including NFS (Network File System) or NSS (Novell Storage Services).

Image file system component 304 provides a mechanism to interpret a file system that is maintained within a file on a second file system. Image file system component 304 typically reads a file system within an image file that comprises a copy of a CD, DVD or other removable persistent storage device. In embodiments running on the Linux operating system, image file system component may comprise what is referred to as a "loop" or "loopback" driver.

Authentication component 302 comprises software that may be used to authenticate software that is run on system 200, and in particular may be used to authenticate, an image file 420 (FIG. 4). Various forms of authentication may be used, including IPSec (Internet Protocol Security), public/private key combinations, shared private keys, HMAC (keyed Hashing for Message Authentication) etc. Further details on authentication methods used in some embodiments may be found in published United States Patent Application 2003/0195033 entitled "Gaming Software Authentication" and filed Apr. 10, 2002.

Figure 4A:
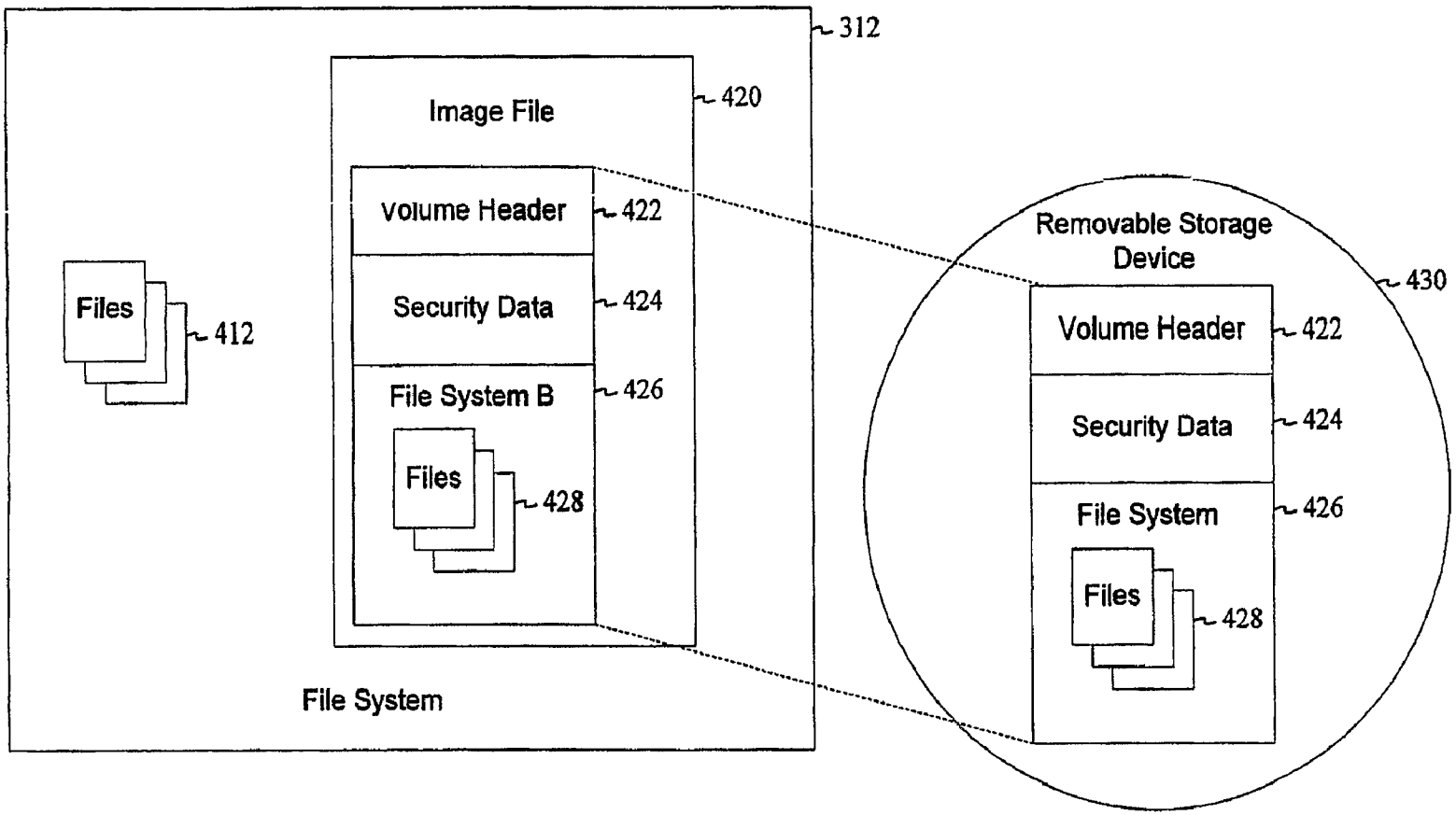
FIGS. 4A and 4B are block diagrams illustrating an image file system on a wagering game machine according to example embodiments.

FIG. 4A is a block diagram illustrating an image file system on a wagering game machine 100 according to example embodiments. As shown in FIG. 4A, a file system 312 may contain multiple files 412 arranged in a directory hierarchy. Among the files on file system 312 may be one or more image files 420. An image file 420 comprises a copy of the complete contents and structure of a removable storage media 430. The removable storage media 430 may be a CD, DVD, flash memory device, removable hard drive, or other removable storage media now known or developed in the future.

A removable storage media 430 may contain a volume header 422, a digital signature 424, and a file system 426 used to maintain and organize one or more files 428. Files 428 may be files related to a wagering game, including one or more wagering game applications, audio and/or video data for the wagering game machine and wagering game applications, configuration information, or any other wagering game related software and/or data. In some embodiments, file system 426 may be an ISO 9660 file system as published by the International Organization for Standardization (ISO). In alternative embodiments, the file system may be a UDF (Universal Disk Format) file system. UDF is an implementation of the ISO/IEC 13346 standard (also known as ECMA-167).

Volume header 422 may contain data such as a label identifying the storage media, and information regarding the type of file system on the storage media.

Security data 424 comprises data that may be used to authenticate and/or authorize the content of a removable storage media 430. Examples of such security data include digital signatures, message digests and other mechanisms designed verify the integrity of the removable media. The security data may be encrypted, and protected by a key such as a public/private key pair. As illustrated in FIG. 4A, security data 424 is not included as part of a file system 426. Keeping security data 424 separate from the file system is desirable because it is harder for a non-privileged user to access security data 424 if it is located outside of a file system 426. In some embodiments, security data 424 is located in blocks that are designated as inaccessible by the file system 426. In alternative embodiments, security data 424 may be in the same partition as a file system 426, but may reside in portions of file system 426 that are not occupied by data for files 312. In further alternative embodiments, the security data 424 may be located in blocks that are marked as "bad" (e.g. blocks that cannot be reliably read or written) in order to conceal the security data.

As discussed above and illustrated in FIG. 4A, the data on removable storage media 430 may be copied to an image file 420 on file system 312. After the copying is complete, the image file 420 will be a replica of the data on the removable storage media.

Figure 4B:
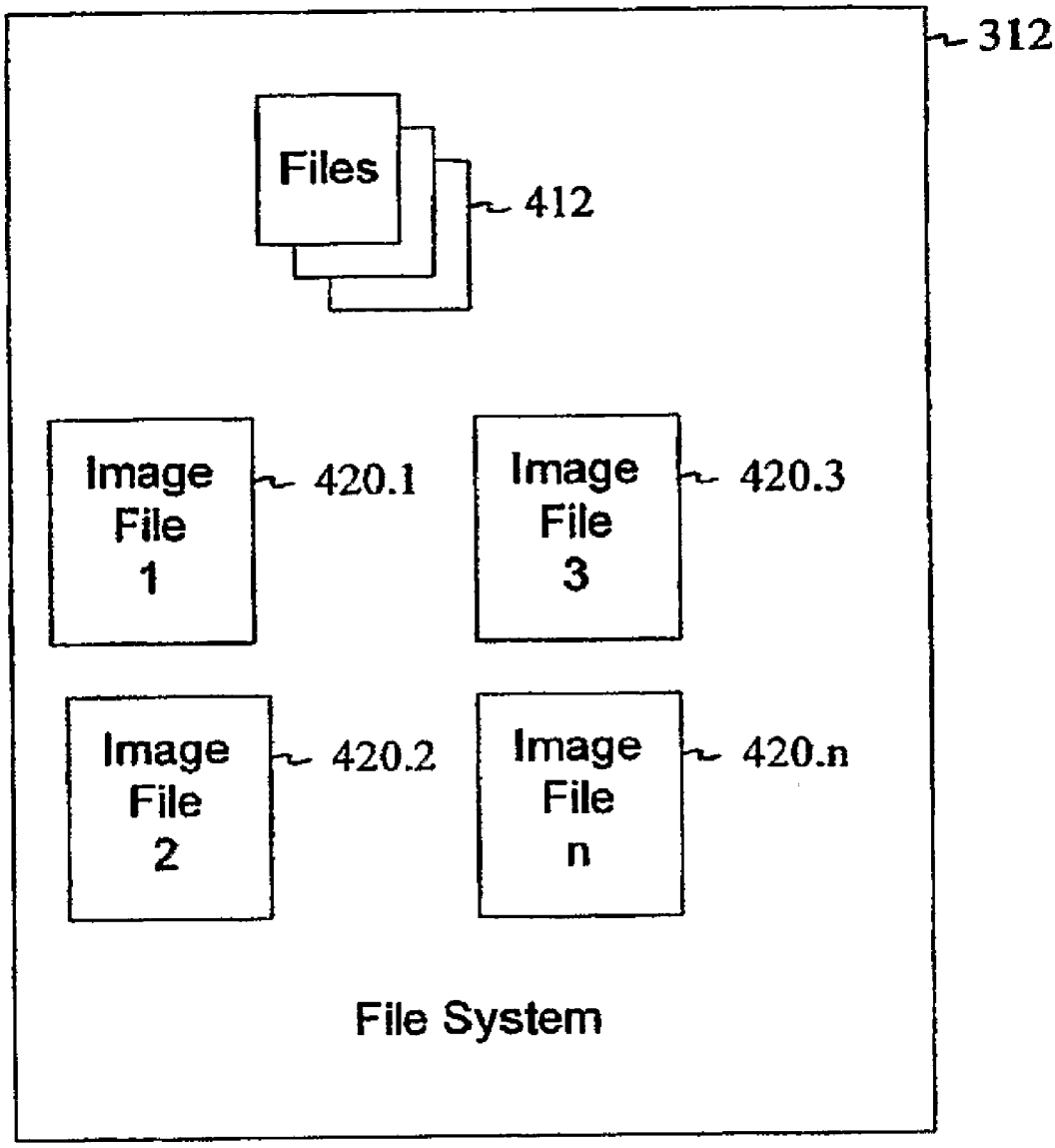

FIG. 4B is a block diagram illustrating a plurality of image file systems on a wagering game machine 100 according to alternative embodiments. As illustrated in FIG. 4B, a first file system 312 may have multiple image files 420.1-410.*n*. Although four image files are shown in FIG. 4B, a file system may include more or fewer image files. Each image file may be a copy of a different removable storage media 430. Further each image file may include a file system having files for a version of a wagering game. Alternatively, each image file may contain different wagering games from the other image files, where the differing wagering games may be loaded onto a wagering game machine 160 depending on a configuration or user selection.

As noted above, the image files may be located on a local persistent storage device 228, a remote persistent storage device 314, or a combination of the two. Image files located on a remote persistent storage device 314 such as a file server, SAN or other network attached storage may be made available to multiple wagering game machines.

Figure 5:
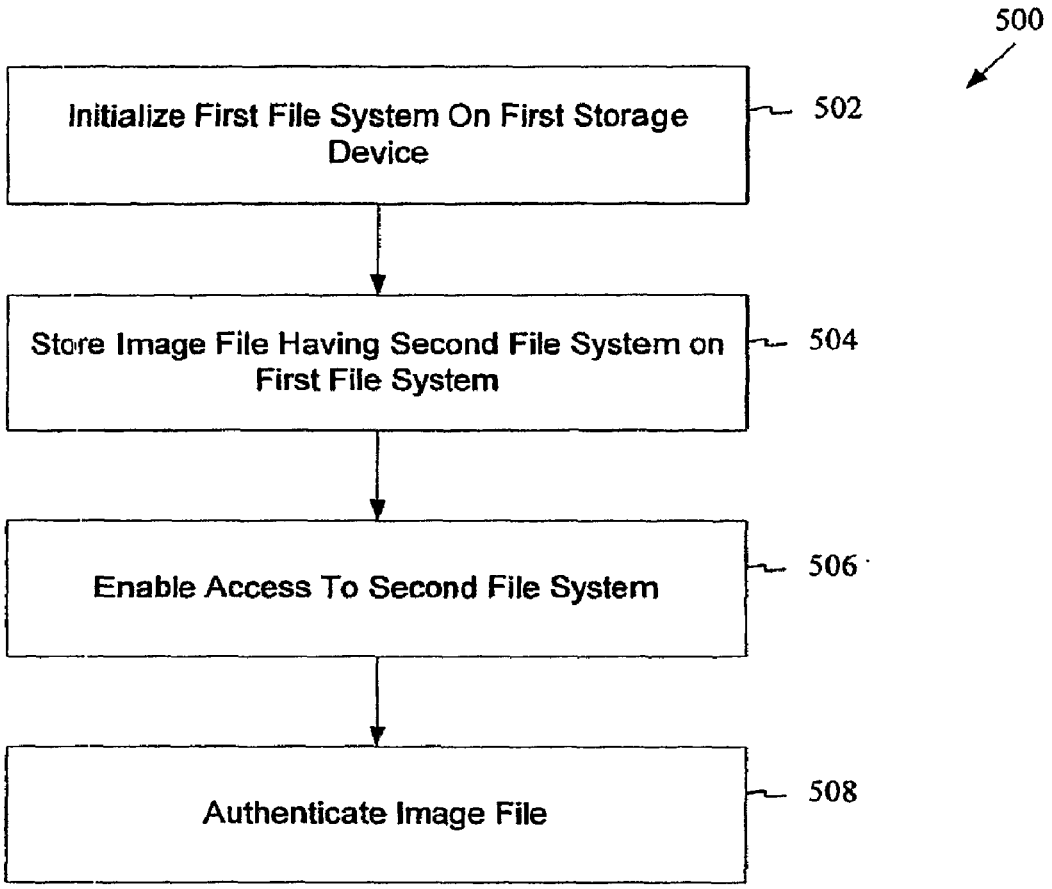
FIG. 5 is a flowchart illustrating methods for providing wagering game related content on an image file system according to example embodiments.

FIG. 5 is a flowchart illustrating methods for providing wagering game related content on an image file system according to example embodiments. The methods to be performed by the embodiments constitute computer programs made up of computer-executable instructions. Describing the methods by reference to a flowchart enables one skilled in the art to develop such programs including such instructions to carry out the method on suitable processors for wagering game machines (the processor or processors of the computer executing the instructions from computer-readable media). The methods illustrated in FIG. 5 are inclusive of acts that may be taken by an operating environment executing an exemplary embodiment of the invention.

The method begins by providing a first file system on a first storage device (block 502). As noted above, the first storage device may be a local device on wagering game machine 100, or it may be a remote device on a file server, SAN, or other network attached storage.

Next, at least one image file is stored on the first file system (block 504). In some embodiments, the image file may be created by reading the entire contents of a removable storage media such as a CD, DVD, flash memory or removable hard drive. In alternative embodiments, a previously created image file may be received over a network connection. In these embodiments, it is desirable to secure the network communication. For example, some embodiments establish an IPSEC (Internet Protocol Security) connection between the image file source and the wagering game machine in order to transfer the image file.

Next, the system enables access to a second file system located within the image file. In some embodiments, access is enabled by mounting the second file system. For example, an image file system may be mounted at a mount point in a first file system. References through the mount point are then directed to the second file system. In some Linux embodiments, a "loop" or "loopback" device option is specified when mounting an image file system.

In some embodiments, the image file may be authenticated to verify the integrity of The image file (block 508). In other words, the image file is checked to make sure the contents have not been altered. As noted above, security data embedded within the image file may be used to check the integrity of the image file.

The image file may be authenticated prior to enabling access to the image file, or when a file on a file system maintained within the image file is accessed. As noted above, various forms of authentication may be utilized, including key based authentication (including private, public, shared keys), HMAC authentication, or any other authentication mechanism now known or developed in the future.

Systems and methods for providing wagering gaming components on a wagering game machine using an image file system have been described. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the inventive subject matter.

The terminology used in this application is meant to include all of these environments. It is to be understood that the above description is intended to be illustrative, and not restrictive. Many other embodiments will be apparent to those of skill in the art upon reviewing the above description. Therefore, it is manifestly intended that this inventive subject matter be limited only by the following claims and equivalents thereof.

The Abstract is provided to comply with 37 C.F.R. §1.72(b) to allow the reader to quickly ascertain the nature and gist of the technical disclosure. The Abstract is submitted with the understanding that it will not be used to limit the scope or meaning of the claims.

What is claimed is:

1. A gaming system comprising:

a wagering game machine operable to receive a wager for a wagering game;

a first storage device coupled to the wagering game machine and having a first file system on which is stored a first image file, the first image file comprising a copy of a removable storage device including a second file system and security data that is separate from the second file system; and an image file system component to read security data from one or more portions of the first image file that are not included as parts of the second file system, the security data being usable by the wagering game machine to access at least one protected file on the second file system.

2. The gaming system of claim 1, wherein the first image file comprises an ISO 9660 image.

3. The gaming system of claim 1, wherein the removable storage device includes a device selected from the group consisting of flash memory, CD-ROM, and DVD-ROM.

4. The gaming system of claim 1, further comprising an authentication module operable to authenticate the first image file.

5. The gaming system of claim 4, wherein the authentication module authenticates the first image file using the security data located within the first image file.

6. The gaming system of claim 5, wherein the security data is located within the first image file in data blocks marked as unreadable.

7. The gaming system of claim 1, wherein the first storage device further receives a second image file having a third file system, the second image file comprising a copy of a second removable storage device.

8. A computer-implemented method of configuring a wagering game machine, the method comprising:

initializing a first file system on a first storage device coupled to the wagering game machine;

storing on the first file system a first image file including a second file system, the second file system including gaming content but not security data that provides access to the gaming content; and reading, via an image file system component, security data from one or more portions of the first image file that are not included in the second file system, the security data providing access to the gaming content in the second file system.

9. The method of claim 8, wherein providing access to the second file system comprises mounting the second file system.

10. The method of claim 8, wherein the first image file comprises an ISO 9660 image.

11. The method of claim 8, wherein the first image file comprises a copy of a removable storage device.

12. The method of claim 8, further comprising authenticating the first image file.

13. The method of claim 12, wherein the authenticating the first image file includes authenticating the security data located within the first image file.

14. The method of claim 5, wherein the security data is located within the first image file in data blocks marked as unreadable.

15. The method of claim 8, further comprising:

receiving a second image file having a third file system, the second image file comprising a copy of a removable storage device; and enabling access to the third file system.

16. A machine readable, non-transitory medium having machine executable instructions for performing a method of configuring a wagering game machine, the method comprising:

initializing a first file system on a first storage device coupled to the wagering game machine;

storing on the first file system a first image file including a second file system, the second file system including gaming content but not security data that provides access to the gaming content; and reading, via an image file system component, security data from one or more portions of the first image file that are not included in the second file system, the security data providing access to the gaming content in the second file system.

17. The machine readable medium of claim 16, wherein providing access to the second file system comprises mounting the second file system.

18. The machine readable medium of claim 16, wherein the first image file comprises an ISO 9660 image.

19. The: machine readable medium of claim 16, wherein the first image file comprises a copy of a device selected from the group consisting of flash memory, CD-ROM, and DVD-ROM.

20. The machine readable medium of claim 16, wherein the method further comprises authenticating the first image file.

* * * * *

UNITED STATES PATENT AND TRADEMARK OFFICE

CERTIFICATE OF CORRECTION

PATENT NO. : 8,075,395 B2
APPLICATION NO. : 12/158014
DATED : December 13, 2011
INVENTOR(S) : Craig J. Sylla It is certified that error appears in the above-identified patent and that said Letters Patent is hereby corrected as shown below:

In column 2, line 5, delete "(existing" and insert -- existing --, therefor.

In column 2, line 60, delete "end" and insert -- and --, therefor.

In column 6, line 40, delete "authenticate," and insert -- authenticate --, therefor.

In column 7, line 45, delete "160" and insert -- 100 --, therefor.

In column 8, line 24, delete "The" and insert -- the --, therefor.

In column 10, line 13, in Claim 15, delete "removable" and insert -- second removable --, therefor.

In column 10, line 36, in Claim 19, delete "The:" and insert -- The --, therefor.

Signed and Sealed this
Thirteenth Day of March, 2012

David J. Kappos

David J. Kappos
*Director of the United States Patent and Trademark Office*